United States Patent [19]

Cassaro, Jr.

[11] Patent Number: 4,815,412

[45] Date of Patent: Mar. 28, 1989

[54] BOAT BOW PROTECTOR

[76] Inventor: Michael Cassaro, Jr., 89 Gansevoort Blvd., Staten Island, N.Y. 10314

[21] Appl. No.: 83,547

[22] Filed: Aug. 6, 1987

[51] Int. Cl.[4] ..... B63B 21/04

[52] U.S. Cl. ..... 114/343; 114/219

[58] Field of Search ..... 114/219, 258, 261, 343, 114/361; 441/1, 133, 136

[56] References Cited

U.S. PATENT DOCUMENTS

| | | | |
|---|---|---|---|
| 2,940,414 | 6/1960 | Moore | 114/219 |
| 3,050,750 | 8/1962 | Harrison | 114/219 |
| 3,055,022 | 9/1962 | Vallquist | 114/343 |
| 3,220,026 | 11/1965 | Lichti | 114/343 |
| 3,540,403 | 11/1970 | Russell | 114/219 |
| 3,693,574 | 9/1972 | Dickey | 114/129 |
| 4,260,282 | 4/1981 | Dorsey et al. | 114/343 |
| 4,667,619 | 5/1987 | Nishida | 114/243 |

*Primary Examiner*—Sherman D. Basinger
*Assistant Examiner*—Stephen P. Avila
*Attorney, Agent, or Firm*—Kenyon & Kenyon

[57] ABSTRACT

Apparatus for protecting the lower bow surface of a marine vessel comprising a planar flexible sheet adapted to conform to the lower bow surface, the sheet having a plurality of lines for attaching the sheet to the vessel including a first line extending from approximately the center of a forward edge of the sheet for fastening to a point disposed on the approximate longitudinal center line of the vessel and a second and third line for attaching to respective additional points on the vessel, at least two lines coupled to respective rear opposite portions of the planar sheet, and floats coupled to each of the at least two lines for exerting a rearward, upward and centering force on the planar sheet means when the sheet means is placed in the water to protect the bow surface and the vessel is moving in a forward direction. A further embodiment using a weight at the rear edge of the sheet to aid in centering of the sheet on the bow is provided.

13 Claims, 3 Drawing Sheets

10
16
18
22
23
24
26

Fig. 8.
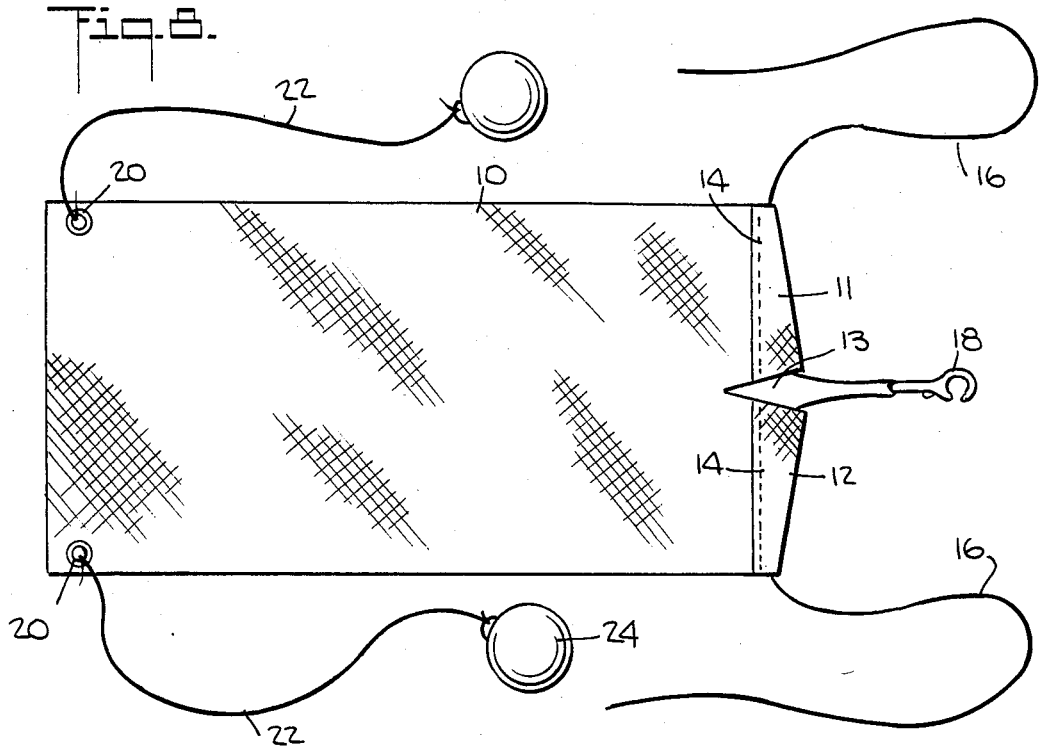
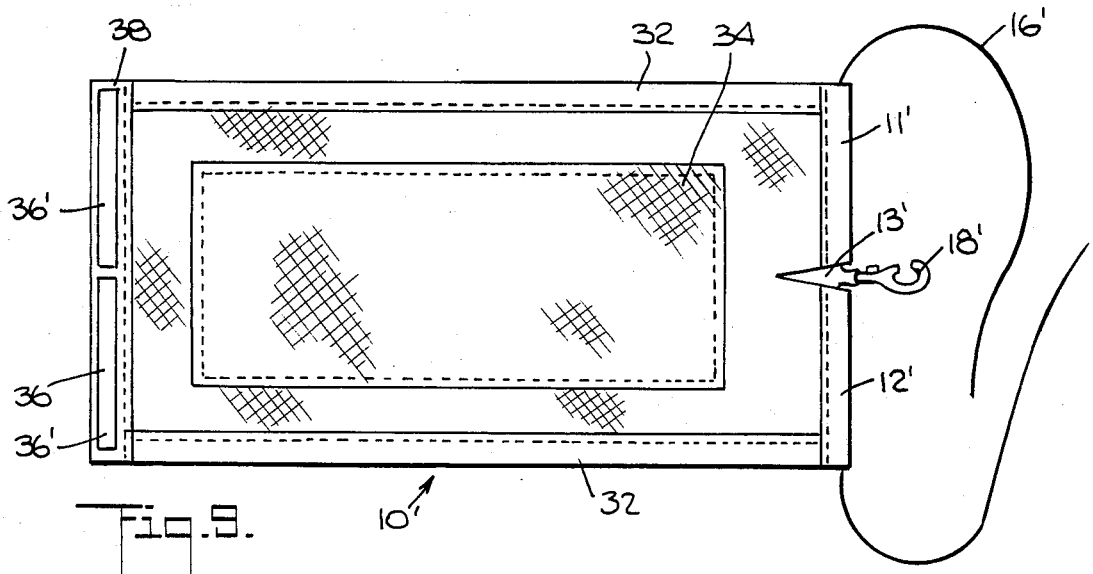
Fig. 9.
Fig. 10.
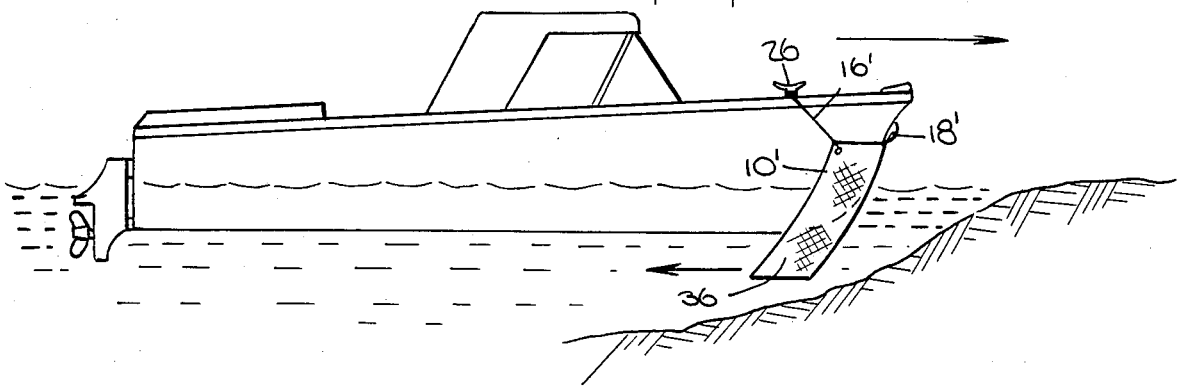

BOAT BOW PROTECTOR

BACKGROUND OF THE INVENTION

The present invention relates to a protective device for the hulls of boats, and in particular, to a protective device for the lower surface of the bow of a boat. More particularly, the present invention is directed to a device for protecting the bow of a boat when the boat is beached on a shore.

Various protective devices for the hulls of maritime vessels are known. For example, U.S. Pat. No. 3,055,022 discloses a boat beaching apron which protects the bow of a boat upon beaching. The boat beaching apron is tied to the bow of the boat with a plurality of lines, and utilizes a V-shaped buoyant element for maintaining the position of the apron on the bow of the boat. Also, the boat beaching apron of this reference utilizes a pair of water scoop means for exerting a drag upon the apron to sweep the apron back under the bow of the boat and drape the apron against the lower portion of the bow.

U.S. Pat. No. 3,220,025 discloses another hull protector for small craft which is attached to the bow of the boat via a hook.

U.S. Pat. No. 4,667,619 shows another form of bottom protector for a small boat.

Another boat protective device is shown in U.S. Pat. No. 2,940,414 and U.S. Pat. Nos. 4,260,282 and 3,693,574 show portable boat ramps and landing apparatus for beaching a boat.

Although the above references show various devices suitable for protecting the bow of a boat when beaching, all the above devices suffer from the limitations that they are either bulky, difficult to use, or do not easily allow the protective device to be positioned on the boat when the boat is waterborne and in a consistent manner such that the protective device can be reliably positioned on the lower surface of the bow of the boat to protect it from damage.

SUMMARY OF THE INVENTION

It is an object of the present invention to provide a boat bow protector which is of simple construction and which can be reliably positioned on the bow of a boat even when the boat is waterborne.

It is yet another object of the present invention to provide such a bow protective device which will protect the bow of the boat on beaching.

It is still yet another object of the present invention to provide such a bow protective device which is sufficiently strong to prevent tearing or ripping thereof when the boat is beached.

It is yet still another object of the present invention to provide such a bow protective device which can be reliably positioned in a centered manner upon the bow of the boat prior to beaching.

The above and other objects of the present invention are provided by an apparatus for protecting the lower bow surface of a marine vessel comprising a planar flexible sheet means adapted to conform to the lower bow surface, the sheet means having a plurality of lines coupled to a front portion thereof for attaching the sheet means to the vessel including a first line extending from approximately the center of a forward edge of the sheet means for fastening to a point disposed on the approximate longitudinal center line of the vessel and a second and third line for attaching to respective additional points on the vessel, at least two lines coupled to respective rear opposite portions of the planar sheet means, and flotation means coupled to each of the at least two lines for exerting a rearward, upward and centering force on the planar sheet means when the sheet means is placed in the water to protect the bow surface and the vessel is moving in a forward direction.

According to a further embodiment of the present invention, the objects of the invention are achieved by an apparatus for protecting a lower bow surface of a marine vessel comprising planar flexible sheet means adapted to conform to the lower bow surface, the sheet means having a plurality of lines attached to a front portion thereof for attaching the sheet means to the vessel including a first line extending from approximately the center of a forward edge of the sheet meas for fastening to a point disposed on the approximate longitudinal center line of the vessel and a second and third line for attaching to respective additional points on the vessel, and a weight disposed at a rear edge of the planar sheet means for exerting a rearward, downward and centering force on the planar sheet means when the sheet means is placed in the water to protect the bow surface and the vessel is moving in a forward direction.

Other objects, features and advantages of the present invention will be apparent from the following description.

BRIEF DESCRIPTION OF THE DRAWINGS

The invention will be explained in greater detail in the following detailed description with reference to the drawings in which:

FIG. 8 is a plan view of the bow protective device of the present invention in laid out form;

FIG. 9 is a plan view of an alternative embodiment of the bow protective device according to the present invention in laid out form; and FIG. 10 shows the bow protective device of FIG. 9 prior to beaching thereof.

DETAILED DESCRIPTION

Figure 7:
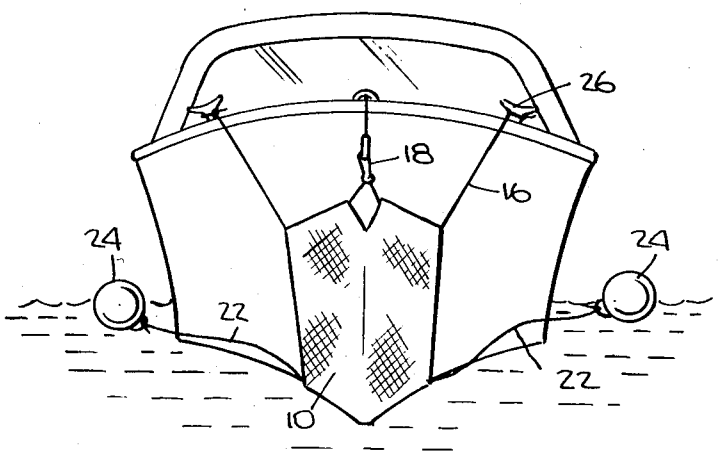
FIG. 7 is a front view of a boat showing the bow protective device in position.

With reference to the drawings, one embodiment of the bow protective device of the present invention is shown in a plan view in FIG. 8. The bow protective device includes a protective member 10, which may be made of a sufficiently strong fabric material, for example, Herculite, which is a vinyl coated canvas material. The dimensions of the material 10 are such that it is sufficient to cover the undersurface of the bow of the boat which may come into contact with the shore upon beaching of the boat. According to the embodiment shown in FIG. 8, the material 10 includes folded-over sections 11 and 12 at the front thereof, which are suitably fastened back on the sheet of material 10 by, for example, stitching 14. Other means of fastening of the folds can be employed, for example rivets. Through the folded sections 11 and 12, a length of line or rope 16 is disposed. Preferably, one single length of rope may be employed and at the approximate center thereof, a hook member 18 for attaching to the bow eye of the boat is provided. The loose ends of the rope 16 are provided of a length sufficient to hold the bow protective device in position on the boat as shown in FIG. 7, for example. Sheet 10 is preferably provided with a V notch 13 in order to aid in centering of the bow protective device on the bow of the boat, as will be explained.

To the rear ends of the sheet 10, two eyes 20 may be provided, to which lengths of rope 22 are attached. The lengths of rope 22 are of equal lengths, and at each of their loose ends, a flotation device 24 is attached thereto. Flotation device 24 may be made of a foam material.

Figures 1, 2, 3, 5:
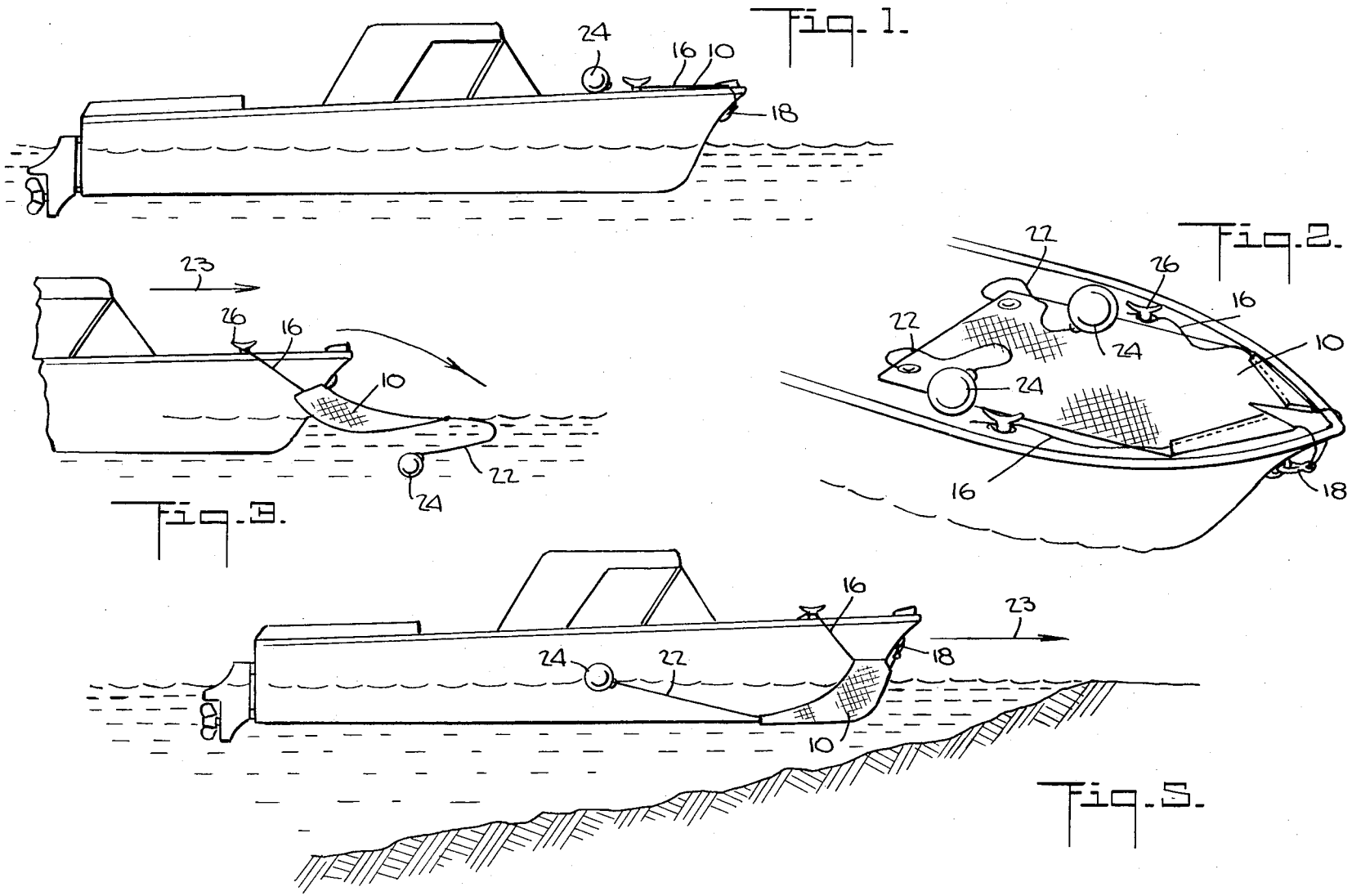
FIG. 1 shows a side view of a boat with the bow protective device of the present invention in its stowed position on the deck of the boat while the boat is in normal use in the water.
FIG. 2 is a perspective view of the bow protective device of the present invention laid out upon the deck of a boat when not in use.
FIG. 3 shows the bow protective device of the present invention after it has been thrown over the front of the bow of the boat into the water prior to positioning of the bow protective device against the bow of the boat.
FIG. 5 is a side view of a boat showing the bow protective device of the present invention prior to beaching.

As shown in FIG. 2, the bow protective device of the present invention is attached to the bow of the boat and may be conveniently stowed on the deck of the boat when not in use. The bow protective device is shown in FIG. 2 in laid out form, although, of course, it may be rolled up and stowed in more compact form if convenient. The lengths of line 16 are tied to mooring anchors 26, for example, provided on the deck of the boat. The hook 18 coupled to the line 16 may be fastened to the bow eye of the boat, which is typically provided on the bow as shown in FIG. 2, although it may be disposed in a somewhat different position, for example, on the deck of the boat at the tip thereof.

Figure 6:
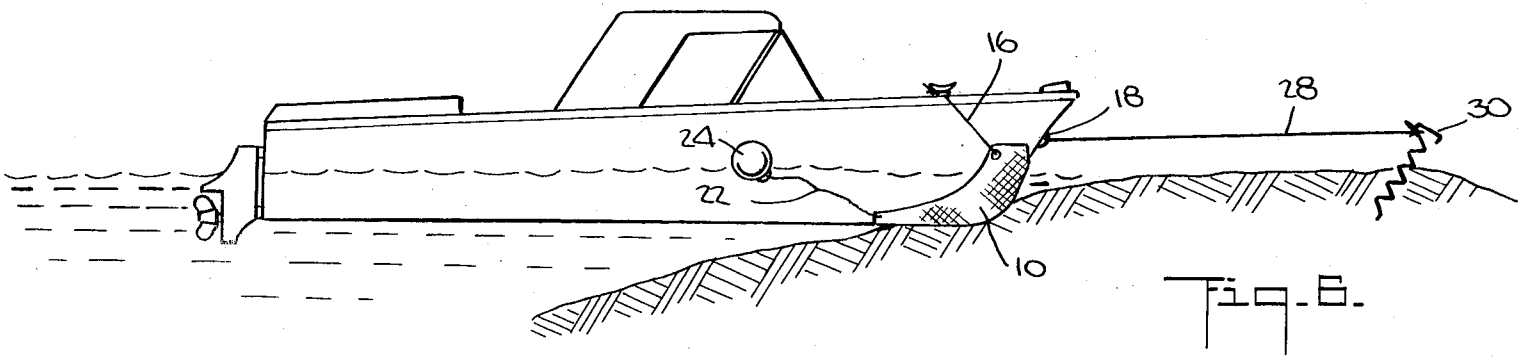
FIG. 6 is a side view of a boat showing the bow protective device of the present invention in position on a beached boat.
Figure 4:
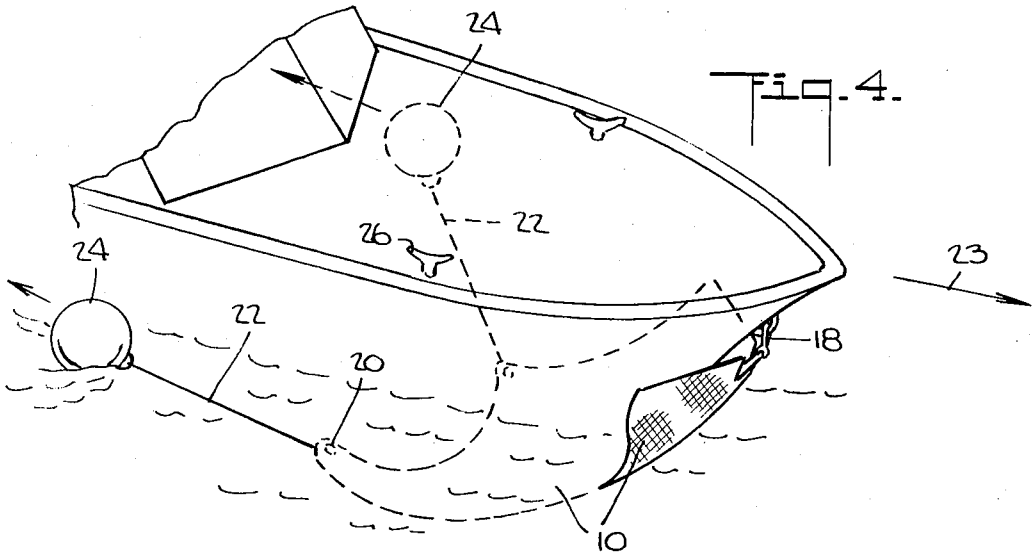
FIG. 4 is a perspective view of the bow protective device of the present invention as it positions itself against the bow of the boat during forward movement of the boat.

Operation of the bow protective device will now be explained. As shown in FIG. 2, the bow protective device may be stowed on the deck of the boat in laid out fashion. To utilize the device, the bow protective device is thrown out over the bow of the boat, as shown in FIG. 3. Each of lines 22 with floats 24 are thrown to the respective starboard and port sides of the boat. As the boat continues forward in the direction of arrow 23, the floats 24 will float rearwardly, along the respective starboard and port sides, and will cause the pad 10 to move rearwardly and into position under the bow of the boat as shown in FIGS. 4 and 5. The bow protective device of the present invention will position itself in a centered fashion on the bow of the boat due to the V-shaped notch 13, the flotation devices 24 and the substantially equal lengths of line 22 which attach the flotation devices to the corners of the protective sheet 10. As shown in FIG. 6, the boat can then be beached without damage to the bow of the boat with the sheet material 10 provided a shield between the bow and the shore. Sheet material 10 must be made of a sufficiently strong material to resist abrasion by the shoreline. As shown in FIG. 6, once the boat is beached, it may be secured to the shoreline by a line 28, and a corkscrew land spike 30 may be utilized as shown to anchor the boat.

The bow protective device according to the present invention provides a very convenient means for protecting the bow of a boat upon beaching. Furthermore, it is easily used and automatically centers itself upon the lower bow surfaces due to the provision of the flotation devices 24.

According to a further embodiment of the invention shown in FIGS. 9 and 10, the bow protective device comprises a sheet of material 10', which again can be made of Herculite or some other sufficiently strong material. The sheet 10' includes two folds 11' and 12' for securing the lines or ropes 16', the loose ends of which are coupled to the mooring anchors 26 which may be provided on the bow deck of the boat. One single length of line 16' an be used, as in the embodiment of FIG. 8, and a V-shaped notch 13' may be provided. As shown in FIG. 9, in order to provide additional strengthening, the sheet of material 10' may have folded edges 32 along the sides thereof, which are appropriately stitched or fastened back onto the sheet 10'. Furthermore, a central portion 34 may be appropriately stitched to the sheet 10' in order to provide additional strengthening in the center of the sheet 10'. Actually, if Herculite is used as the material, the strengthened side portions 32 and the strengthened center portion 34 generally are not required. However, if an ordinary canvas material is used, these strengthened portions may be necessary. At the back of the sheet 10', the material is folded over onto itself at 38 and appropriately stitched, and a weight, preferably of lead, or some other heavy material, as shown by 36, is sewed within the confines of the fold 38. The weight 36 may be divided into two pieces 36' as shown in order to allow flexing to conform to the generally V-shaped contour of a boat hull.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. Apparatus for protecting the lower bow surface of a marine vessel comprising:

planar flexible sheet means adapted to conform to the lower bow surface, said sheet means having a plurality of lines coupled to a front portion thereof for attaching said sheet means to the vessel including a first line extending from approximately the center of a forward edge of the sheet means for fastening to a point disposed on the approximate longitudinal center line of the vessel and a second and third line for attaching to respective additional points on the vessel;

at least two lines coupled to respective rear opposite portions of the planar sheet means; and flotation means coupled to each of said at least two lines for exerting a rearward, upward and centering force on said planar sheet means when said sheet means is placed in the water to protect said bow surface and said vessel is moving in a foward direction.

2. The apparatus recited in claim 1, wherein said plurality of lines comprises a single length of rope material.

3. The apparatus recited in claim 1, wherein said at least two lines are of equal length.

4. The apparatus recited in claim 1, wherein said flotation means comprise a foam material.

5. The apparatus recited in claim 2, wherein said planar sheet means comprises a fold at a front edge thereof secured onto itself for securing said single length of rope material in the fold.

6. The apparatus recited in claim 5, wherein said fold comprises two folds separated from each other along the approximate center line of the planar sheet means with said first line extending from between said two folds.

7. The apparatus recited in claim 1, further comprising a V-shaped notch disposed at the center of the forward edge extending along substantially the longitudinal center line of the planar sheet means for aiding in centering the bow protective device on the bow surface.

8. The apparatus recited in claim 1, wherein said planar sheet means is substantially rectangular in shape.

9. Apparatus for protecting a lower bow surface of a marine vessel comprising:

planar flexible sheet means adapted to conform to the lower bow surface, said sheet means having a plurality of lines coupled to a front portion thereof for attaching said sheet means to the vessel including a first line extending from approximately the center of a forward edge of the sheet means for fastening to a point disposed on the approximate longitudinal center line of the vessel and a second and third line for attaching to respective additional points on the vessel;

a weight disposed at a rear edge of said planar sheet means for exerting a rearward, downward and centering force on said planar sheet means when said sheet means is placed in the water to protect said bow surface and said vessel is moving in a forward direction; and a V-shaped notch disposed at the center of the forward edge of the planar sheet means extending along substantially the longitudinal center line of the planar sheet means for aiding in centering the bow protective device on the bow surface.

10. The apparatus recited in claim 9, wherein said plurality of lines comprises a single length of rope material.

11. The apparatus recited in claim 10, wherein said planar sheet means comprises a fold at a front edge thereof secured onto itself for securing said single length of rope material in the fold.

12. The apparatus recited in claim 11, wherein said fold comprises two folds separated from each other along the approximate center line of the planar sheet means with said first line extending from between said two folds.

13. The apparatus recited in claim 9, wherein said planar sheet means is substantially rectangular in shape.

* * * * *